US011280350B2

(12) United States Patent
Li

(10) Patent No.: US 11,280,350 B2
(45) Date of Patent: Mar. 22, 2022

(54) FAN AND A FAN LAMP THEREOF

(71) Applicant: Min Li, Chongqing (CN)

(72) Inventor: Min Li, Chongqing (CN)

( * ) Notice: Subject to any disclaimer, the term of this patent is extended or adjusted under 35 U.S.C. 154(b) by 127 days.

(21) Appl. No.: 16/826,684

(22) Filed: Mar. 23, 2020

(65) Prior Publication Data

US 2020/0362878 A1 Nov. 19, 2020

(30) Foreign Application Priority Data

May 14, 2019 (CN) ..... 201920687228.0

(51) Int. Cl.

| | |
|---|---|
| ***F04D 29/36*** | (2006.01) |
| ***F21V 33/00*** | (2006.01) |
| ***F04D 19/00*** | (2006.01) |
| ***F04D 25/08*** | (2006.01) |

(52) U.S. Cl.

CPC ..... *F04D 29/36* (2013.01); *F04D 19/002* (2013.01); *F04D 25/088* (2013.01); *F21V 33/0096* (2013.01)

(58) Field of Classification Search

None

See application file for complete search history.

(56) References Cited

U.S. PATENT DOCUMENTS 6,213,716 B1 * 4/2001 Bucher ..... F04D 25/088 416/142
6,666,652 B2 * 12/2003 Bucher ..... F04D 25/088 416/210 R
6,863,498 B2 * 3/2005 Liang ..... F04D 29/36 416/142
7,153,100 B2 * 12/2006 Frampton ..... F04D 25/088 416/5
8,292,585 B2 * 10/2012 Liu ..... F04D 25/088 416/143
8,864,463 B2 * 10/2014 Conley ..... F04D 29/364 416/1
9,506,644 B2 * 11/2016 Liu ..... F21V 33/0096
10,851,798 B2 * 12/2020 Conley ..... F04D 29/364

FOREIGN PATENT DOCUMENTS

CN 109026777 A * 12/2018

* cited by examiner

*Primary Examiner* — Juan G Flores

(74) *Attorney, Agent, or Firm* — Muncy, Geissler, Olds & Lowe, P.C.

(57) ABSTRACT

A fan, which has a downrod and a motor fixed at the bottom of the downrod; the motor drives a rotating disc, and a plurality of mounting brackets are installed on the rotating disc, which can swing up and down in the vertical direction with the connection with the rotating disk as a shaft; the outer end of the mounting bracket can be rotatably installed with a blade, the blade and the mounting bracket can swing up and down in the vertical direction as a whole so as to be adjusted to the most balanced position, canceling the vibration caused by the installation and weight error of the blade, and carry out internal self-regulation, so it can reduce the overall shaking; the blade does not have an upwarped part, and there is a certain distance between the adjacent two blades, which will not cover and overlap.

6 Claims, 9 Drawing Sheets

A-A

FAN AND A FAN LAMP THEREOF

TECHNICAL FIELD

The invention relates to the technical field of fans, in particular to a fan and a fan lamp thereof.

BACKGROUND

At present, central air conditioning systems, air conditioners, exhaust fans, ceiling fans or fans are installed in buildings to accelerate the air exchange and circulation between indoor and outdoor. Ceiling fans are one of those widely used. In buildings, ceiling fans are installed on the ceiling, which does not occupy people's activity space. Combined with the use of air conditioning systems and air conditioners, the effect of cooling the room is more significant. Ceiling fan lamps are the perfect combination of lamps and ceiling fans. They have both the decorative property of lamps and the practicability of fan. It is widely used in decoration currently.

In the existing fan lamps, the blades are directly installed on the rotating part. When the ceiling fan is turned on, the blades rotate relative to the rotating part in the horizontal direction under the action of centrifugal force. Because the installation tightness of each installation position cannot be completely unified, and there is certain error during the production and manufacturing process of the structures such as the blades and connecting parts, there is a small difference in weight between multiple blades. Due to the difference of weight, it may produce large vibrations when rotating at high speed, which may drive the whole fan to produce obvious shaking, and therefore resulting in poor balance. After working for a long time, it may cause damage to the installation structure, and there is a potential safety hazard. At the same time, the vibration of the fan blade may produce large noise, and result in poor use effect.

In the existing fan lamps, the blades are generally of a retractable structure, and the tail end of the blades is upwarped. When they are retracted, the blades cover and overlap each other to reduce the space occupied by the blades, and increase the area of the blades in a certain space. After a long time of use, the blades will have certain deformation under the influence of gravity and centrifugal force, which may cause the blades to jam with each other and make the blades unable to retract normally, affecting normal use; and the existing fan blades are generally of an inclined plate design, the surface is flat and lack of radian. When the fan blades are too close to the ceiling, the wind force is obviously insufficient, and the air flow effect is not good, large vertical installation space is required, and it is inconvenient to use on floors with low ceilings.

Therefore, urgent technical problems to be solved in the industry are that of how to reduce the vibration of the fan blades, and reduce the shaking of the fan lamps, improve the balance of the fan lamps, reduce the noise in the use process, optimize the structure of the fan blades, avoid the jamming between the fan blades which affects the normal retraction and release of the fan blades, and improve the blowing effect.

SUMMARY

The purpose of the invention is to provide a fan and a fan lamp, aiming at reducing the vibration of the fan blades, thereby reducing the shaking of the fan lamps, improving the balance of the fan lamps, reducing the noise in the use process, optimizing the structure of the fan blades, avoiding the jamming between the fan blades which affects the normal retraction and release of the fan blades, and improving the blowing effect.

In order to achieve the above purpose, the technical solution of the present invention is: a fan, includes a downrod and a motor fixed at the bottom of the downrod, the motor is provided with a rotating disk driven by the motor, and the rotating disk is equipped with a plurality of mounting brackets, which can swing up and down in the vertical direction with the connection with the rotating disk as a shaft, and the outer end of each mounting bracket can be rotatably installed a blade, the blade can be rotated on the mounting bracket to be opened and retracted, and a portion between the front edge and the rear edge of the blade is convex upward, the cross section of the blade is an upward convex arc, and the front edge of the blade is concave arc, the rear edge is a convex arc, and the blade is arcuate as a whole when viewed from the horizontal plane, the front edge of the blade is located at a higher level than the rear edge, the blade includes a connecting end and an outer end, when a plurality of the blades are located in a retracted position, the height of the front edge of the blade is at the same level from the connecting end to the outer end, and the height of the rear edge of the blade is at the same level from the connecting end to the outer end, and a gap is created between the outer end of the blade and the connecting end of the adjacent another blade, and there is no overlap between the two adjacent blades.

Preferably, the connecting end of the blade is provided with a mounting hole, the outer end of the mounting bracket is provided with a sink with a through hole, the sink is provided with a bearing which can make the blade rotate relative to the mounting bracket, the mounting hole is provided with a bolt passing through the bearing and the mounting bracket, and the bottom end of the bolt is threaded-connected with a rotating cover which can rotate with the blade, and the bolt and the rotating cover cooperate to connect the blade and the mounting frame.

Preferably, the rotating cover is provided with a torsion spring, one end of the torsion spring is fixed on the mounting bracket, and the other end is fixed on the rotating cover, when the blade is opened, the rotation of the rotating cover causes the torsion spring to deform and generate elastic force.

Preferably, the rotating cover is provided with an upward raised limiting block, and the outer end of the mounting bracket is provided with a clamp which is matched with the limiting block to limit the rotating cover.

Preferably, the downrod is sleeved with a protective cover which can cover the motor.

A fan lamp includes a downrod and a motor fixed at the bottom end of the downrod, the motor is provided with a rotating disk driven by the motor, and the rotating disk is equipped with a plurality of mounting brackets, which can swing up and down in the vertical direction with the connection with the rotating disk as a shaft, and the outer end of each mounting bracket can be rotatably installed a blade, the blade can be rotated on the mounting bracket to be opened and retracted, and a portion between the front edge and the rear edge of the blade is convex upward, the cross section of the blade is an upward convex arc, and the front edge of the blade is concave arc, the rear edge is a convex arc, and the blade is arcuate as a whole when viewed from the horizontal plane, the front edge of the blade is located in a higher level than the rear edge, the blade includes a connecting end and an outer end, when a plurality of the blades are located in a retracted position, the height of the front edge of the blade is at the same level from the connecting end to the outer end, and the height of the rear edge of the blade is at the same level from the connecting end to the outer end, and a gap is created between the outer end of the blade and the connecting end of the adjacent another blade, and there is no overlap between the two adjacent blades, and a lamp is arranged at the bottom of the motor.

After adopting the above solution, the beneficial effect of the invention is: the blade is arranged on the mounting bracket by setting the mounting bracket which can swing up and down, when the blade is opened and rotated by centrifugal force, the blade and the mounting bracket can swing in the vertical direction as a whole so as to be adjusted to the most balanced position, canceling the vibration caused by the installation and weight error of the blade, and carry out internal self-regulation, so it can reduce the overall shaking of fan lamp, improve the balance effect of fan lamp and improve the stability of installation.

Adjusting the structure of the blade, the outer end (tail end) and the connecting end (head end) of the blade are in the same plane, without upwarped part. There is a certain distance between the two adjacent blades, which will not cover and overlap, avoiding the deformation of the blades after a long time of use and the looseness of the installation structure of the blades, which cause the blades to jam with each other and fail to retract and release normally, so as to ensure proper use.

The blades are curved upwards on the surface, which is different from the original straight inclined fan blades, resulting in better air flow. It can be installed closer to the ceiling without affecting the air volume and maintains the blowing effect.

Figure 1:
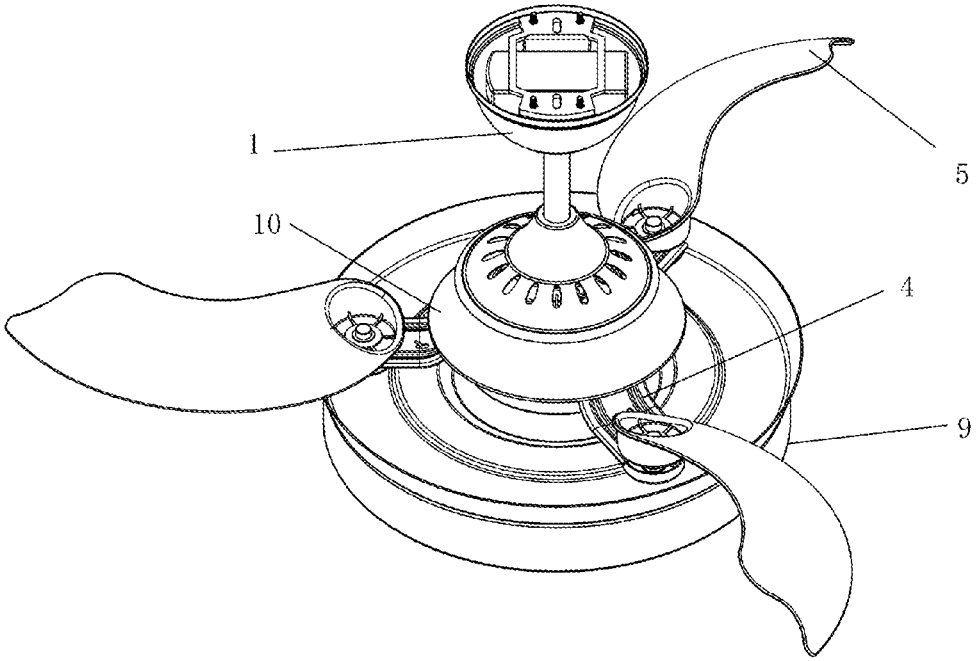
FIG. 1 is a perspective view of the unfolded state of the invention.

In the figure: 1. downrod; 2. motor; 3. rotating disk; 4. mounting bracket; 41. sink; 42. bearing; 43. clamp; 44. shaft; 45. mounting base; 5. blade; 51. mounting hole; 52. reinforcing rib; 53. front edge; 54. rear edge; 6. rotating cover; 61. limiting block; 7. torsion spring; 8. bolt; 9. lamp; 10. protective cover.

The realization, functional features and advantages of the invention will be further described with reference to the attached drawings in combination with the embodiment.

DETAILED DESCRIPTION

It should be understood that the specific embodiments described herein are for the sole purpose of explaining the invention and are not for defining the invention.

Referring to FIGS. 1-9, an embodiment of the invention is proposed. A fan includes a downrod 1 and a motor 2 fixed at the bottom end of the downrod 1. The motor 2 is an outer rotor motor, the rotor is outside, and the stator is inside. The bottom end of the downrod 1 is fixedly connected with the stator of the motor 2. The motor 2 is provided with a rotating disk 3 driven by the motor 2, which is fixedly connected to the rotor of the motor 2 and rotates with the rotation of the rotor.

A plurality of mounting brackets 4 are installed on the rotating plate 3. The mounting frame 4 can swing up and down in the vertical direction with the connection with the rotating plate 3 as the shaft. The mounting frame 4 can be provided with a plurality of mounting bases 45 which are suitable for the mounting frame 4. The mounting frame 4 can be installed on the mounting base 45 by means of hinges, so that the mounting frame 4 can swing up and down around the shaft 44 of the mounting base 45.

Figure 9:
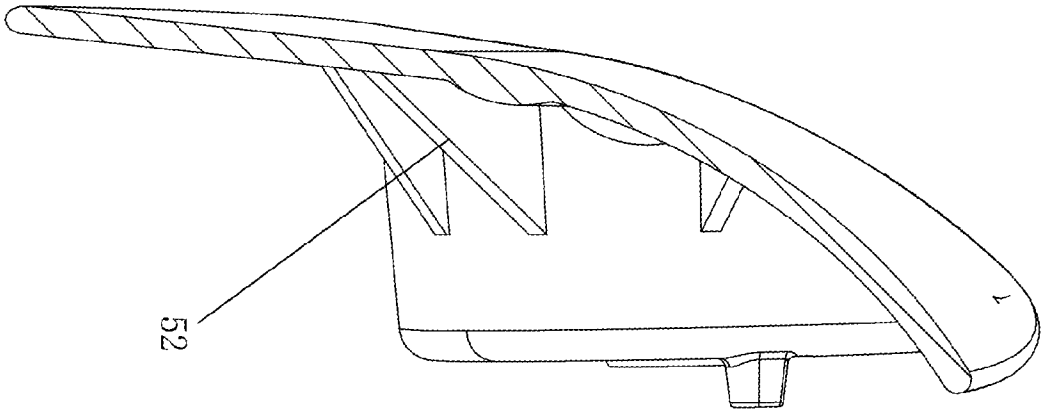
FIG. 9 is a cross-section of FIG. 8.

A blade 5 is rotatably installed on the outer end of each mounting bracket 4, and the blade 5 can be rotated on the mounting frame 4 to be opened and retracted. A reinforcing rib 52 (as shown in FIG. 9) is arranged on the lower surface of the blade 5 to improve the structural strength of the blade 5. When the fan works, the rotation of the motor 2 drives the rotation of the rotating disk 3, so as to drive the rotation of the mounting bracket 4 and the blade 5, and the blade 5 rotates relative to the mounting bracket 4 under the action of centrifugal force and expands in the horizontal direction, the rotation of the rotating disk 3 drives the air to generate wind. In the process of rotation, the blade 5 and the mounting bracket 4 slightly swing in the vertical direction to adjust themselves, so that multiple blades 5 cooperate with each other to achieve balance and reduce the vibration of the blade 5, so as to reduce the overall shaking of the fan, improve the stability, run more smoothly, and reduce the noise.

Figure 6:
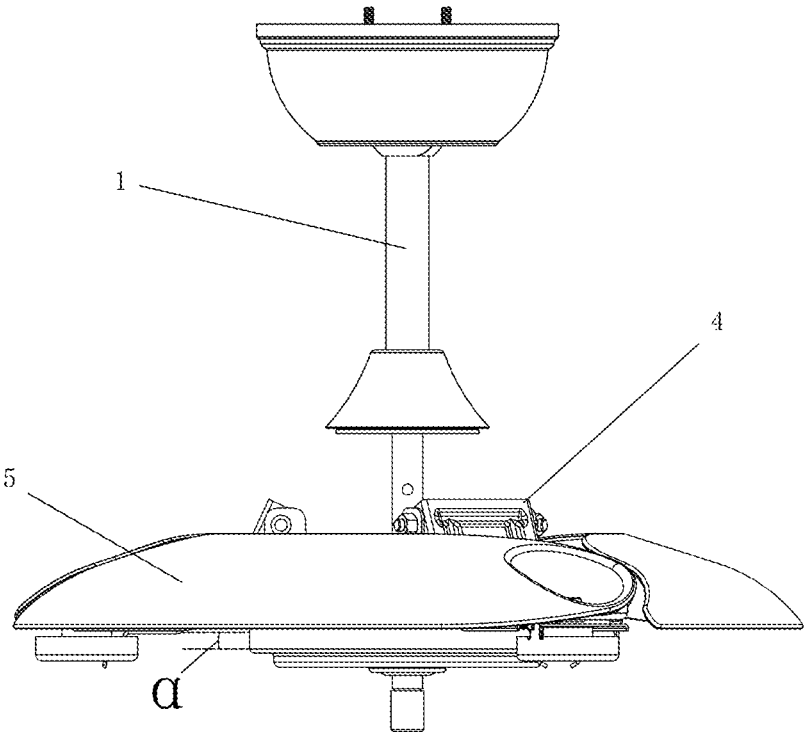
FIG. 6 is a schematic diagram of an embodiment of the stowed state of the present invention.
Figure 7:
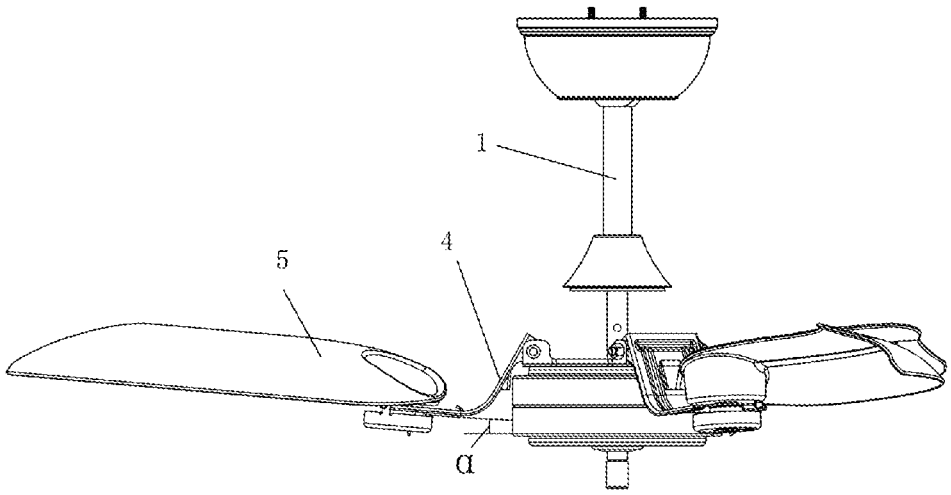
FIG. 7 is a schematic diagram of an embodiment of the unfolded state of the invention.

As shown in FIG. 6 and FIG. 7, when the blade 5 is in the unfolded position, the blade 5 and the mounting bracket 4 are at the lowest point, and the outer end of the mounting bracket 4 is parallel to the horizontal plane, i.e. the outer end of the mounting bracket 4 is in a horizontal state; when the blade 5 is opened and rotated, the mounting bracket 4 is in balance, and acts with blade 5 in a vertical direction, so that the lower edge of the outer end of the mounting bracket 4 forms an included angle $\alpha$ with the horizontal plane; when rotating at a low speed, the angle $\alpha$ is 5°; when rotating at medium speed, the angle $\alpha$ is 7°; when rotating at high speed, the angle $\alpha$ is 9°.

Figure 2:
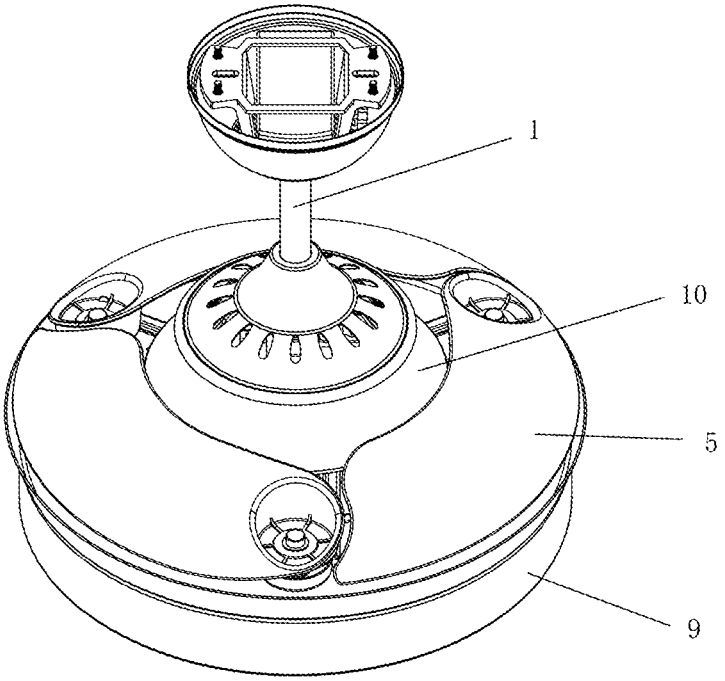
FIG. 2 is a perspective view of the stowed state of the present invention.
Figure 3:
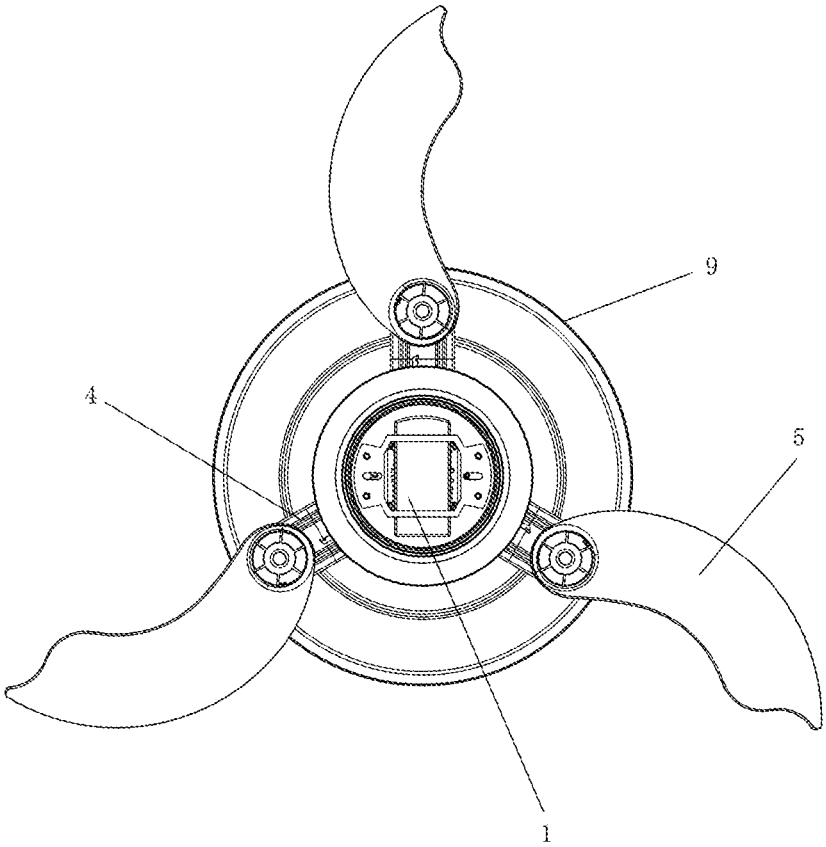
FIG. 3 is a top view of the unfolded state of the invention.
Figure 4:
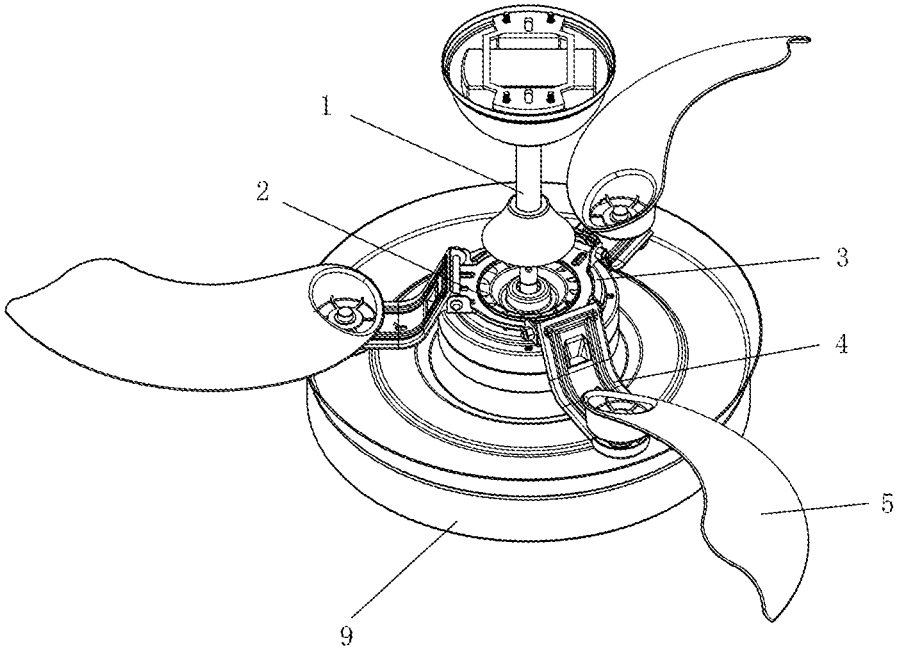
FIG. 4 is a perspective view of the unfolded state of the invention.
Figure 5:
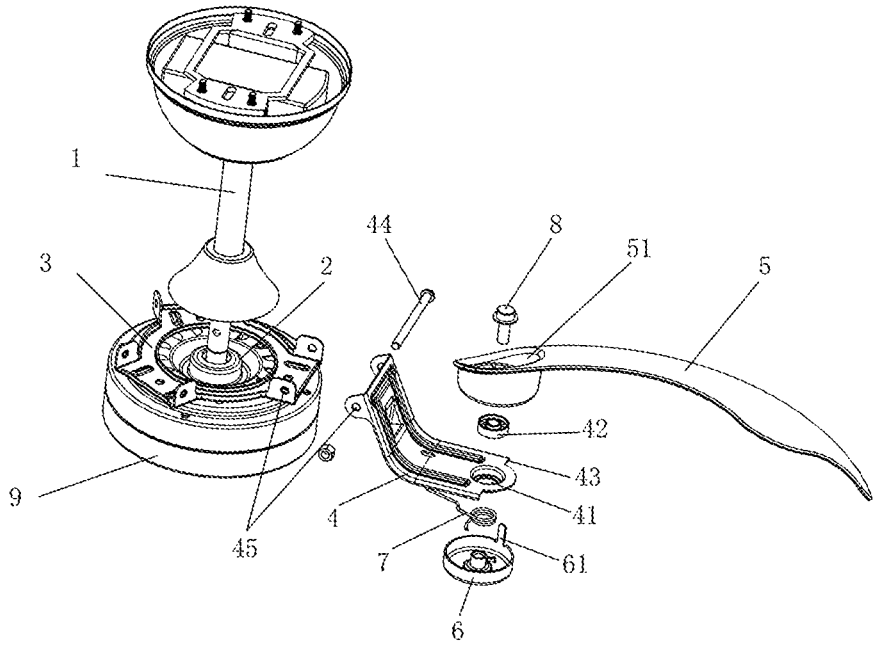
FIG. 5 is an exploded view of the present invention.
Figure 8:
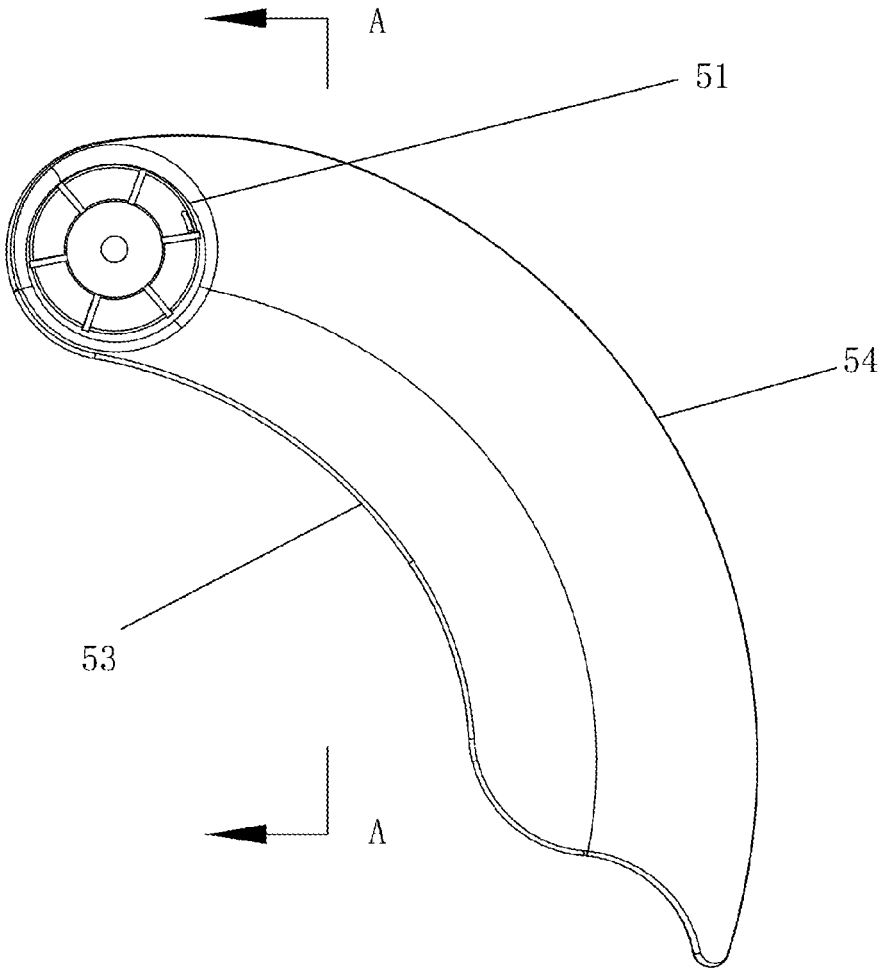
FIG. 8 is a top view of the blade.

As shown in FIG. 2, when the blade 5 is in the retracted position, the part between the front edge 53 and the rear edge 54 of blade 5 is raised upward, and the cross section of the blade 5 is an upward raised arc (as shown in FIG. 8), so that the lower surface of the blade 5 is concave arc (forming a depression), the upper surface of the blade 5 is convex, the front edge 53 of blade 5 is concave arc, and the rear edge 54 is convex arc, and the blade 5 is arcuate as a whole when viewed from the horizontal plane, the front edge 53 of the blade 5 is located in a higher level than the rear edge 54. The blade 5 includes a connecting end and an outer end. When a plurality of the blades 5 are located in a retracted position, the height of the front edge 53 of the blade 5 is at the same level from the connecting end to the outer end, and the height of the rear edge 54 of the blade 5 is at the same level from the connecting end to the outer end, i.e., the blade 5 has no upwarped part, and the connecting end and the outer end are at the same horizontal height. There is a gap between the outer end of blade 5 and the connecting end of the adjacent other blade 5, that is, in the horizontal direction, there is a certain distance between the two adjacent blades 5, so that the two adjacent blades 5 do not contact in the horizontal plane, the two adjacent blades 5 do not cover or overlap, in the top direction, the two adjacent blades 5 are independent and do not contact each other.

The connecting end of the blade 5 is provided with a mounting hole 51, the outer end of the mounting bracket 4 is provided with a sink 41 with a through hole, the sink 41 is provided with a bearing 42 which can make the blade 5 rotate relative to the mounting bracket 4, and the bearing 42 is arranged between the blade 5 and the mounting bracket 4, so that the blade 5 can rotate freely relative to the mounting bracket 4, reducing wear and noise. A bolt 8 passing through the bearing 42 and the mounting bracket 4 is arranged in the mounting hole 51. The bottom end of the bolt 8 is threaded-connected with a rotating cover 6 which can rotate with the blade 5. The bolt 8 and the rotating cover 6 cooperate to connect the blade and the mounting bracket 4.

A torsion spring 7 is arranged in the rotating cover 6. One end of the torsion spring 7 is fixed on the mounting bracket 4 and the other end is fixed on the rotating cover 6. When the blade 5 is opened, the rotating cover 6 causes the torsion spring 7 to deform and produce elastic force. When the motor 2 stops working, the centrifugal force disappears. At this time, the torsion spring 7 resets, so as to push the rotating cover 6 to rotate and drive the blade 5 to rotate and reset, making the blade 5 rotate to the retracted position.

When the blade 5 is in the retracted position, the torsion spring 7 is in a balanced state. The larger the rotation and expansion amplitude of the blade 5, the more serious the deformation of the torsion spring 7, the greater the elastic force generated. When the centrifugal force disappears, the elastic force pushes the blade 5 to rotate and reset.

The rotating cover 6 is provided with a convex limiting block 61, and the outer end of the mounting bracket 4 is provided with a clamp 43 which is matched with the limiting block 61 to limit the rotating cover 6. When the blade 5 is expanded to the optimal position with the largest wind force of the same power, the blade 5 is expanded to the maximum angle. At this time, the rotating cover 6 is rotated to the maximum angle with the blade 5. Meanwhile, the limiting block 61 is rotated to the position where it is clamped with the clamp 43 with the rotating cover 6, so that the rotating cover 6 cannot continue to rotate, and further limit the blade 5. At last, the blade 5 is unable to continue to expand after being extended to the maximum angle under the action of centrifugal force, and avoids insufficient wind caused by insufficient expansion of the blade 5.

The downrod 1 is provided with a protective cover 10 which can cover the motor 2. The protective cover 10 can protect the motor 2 to prevent sundries and dust from falling onto the motor 2 and the rotating disk 3, and affecting the rotation.

A fan lamp includes a downrod 1 and a motor 2 fixed at the bottom end of the downrod 1. The motor 2 is provided with a rotating disk 3 driven by the motor 2, and the rotating disk 3 is equipped with a plurality of mounting brackets 4, which can swing up and down in the vertical direction with the connection with the rotating disk 3 as a shaft. The outer end of each mounting bracket 4 can be rotatably installed a blade 5 which can be rotated on the mounting bracket 4 to be opened and retracted. A portion between the front edge 53 and the rear edge 54 of the blade 5 is convex upwards, the cross section of the blade 5 is an upward convex arc. The front edge 53 of the blade 5 is concave arc, and the rear edge 54 is a convex arc. The blade 5 is arcuate as a whole when viewed from the horizontal plane. The front edge 53 of the blade 5 is located in a higher level than the rear edge 54. Further, the blade 5 includes a connecting end and an outer end. When a plurality of the blades 5 are located in a retracted position, the height of the front edge 53 of the blade 5 is at the same level from the connecting end to the outer end, while the height of the rear edge 53 of the blade 5 is at the same level from the connecting end to the outer end. And, a gap is created between the outer end of the blade 5 and the connecting end of the adjacent another blade 5. There is no overlap between the two adjacent blades 5, and a lamp 9 is arranged at the bottom of the motor 2.

The above are detailed descriptions of the preferred embodiments of the present disclosure, but the present disclosure is not limited to the embodiments, various equivalent deformations or substitutions can be made by those skilled in the art without departing from the nature of the present disclosure, and these equivalent deformations or substitutions are all included in the scope defined by the claims of the present application.

The invention claimed is:

1. A fan, includes a downrod and a motor fixed at a bottom of the downrod, wherein, the motor is provided with a rotating disk driven by the motor, and the rotating disk is equipped with a plurality of mounting brackets, which can swing up and down in a vertical direction with a connection with the rotating disk as a shaft, and an outer end of each of the plurality of mounting brackets can be rotatably installed with a blade, the blade can be rotated on the each of the plurality of mounting brackets to be opened and retracted, and a portion between a front edge and a rear edge of the blade is convex upward, a cross section of the blade is an upward convex arc, and the front edge of the blade is a concave arc, the rear edge is a convex arc, and the blade is arcuate as a whole when viewed from a horizontal plane, the front edge of the blade is located in a higher level than the rear edge, the blade includes a connecting end and an outer end, when each blade is located in a retracted position, the height of the front edge of the blade is at the same level from the connecting end to the outer end, and the height of the rear edge of the blade is at the same level from the connecting end to the outer end, and a gap is created between the outer end of the blade and the connecting end of another adjacent blade, and there is no overlap between two adjacent blades.

2. The fan according to claim 1, wherein the connecting end of the blade is provided with a mounting hole, the outer end of the each of the plurality of mounting brackets is provided with a sink with a through hole, the sink is provided with a bearing which can make the blade rotate relative to the each of the plurality of mounting brackets, the mounting hole is provided with a bolt passing through the bearing and the each of the plurality of mounting brackets, and a bottom end of the bolt is threaded-connected with a rotating cover which can rotate with the blade, and the bolt and the rotating cover cooperate to connect the blade and the each of the plurality of mounting brackets.

3. The fan according to claim 2, wherein the rotating cover is provided with a torsion spring, one end of the torsion spring is fixed on the each of the plurality of mounting brackets, and an other end is fixed on the rotating cover, when the blade is opened, the rotation of the rotating cover causes the torsion spring to deform and generate elastic force.

4. The fan according to claim 2, wherein the rotating cover is provided with an upward raised limiting block, and the outer end of the each of the plurality of mounting brackets is provided with a clamp which is matched with the limiting block to limit the rotating cover.

5. The fan according to claim 1, wherein the downrod is sleeved with a protective cover which can cover the motor.

6. A fan lamp includes a downrod and a motor fixed at a bottom end of the downrod, wherein, the motor is provided with a rotating disk driven by the motor, and the rotating disk is equipped with a plurality of mounting brackets, which can swing up and down in a vertical direction with a connection with the rotating disk as a shaft, and an outer end of each of the plurality of mounting brackets can be rotatably installed with a blade, the blade can be rotated on the each of the plurality of mounting brackets to be opened and retracted, and a portion between a front edge and a rear edge of the blade is convex upward, the cross section of the blade is an upward convex arc, and the front edge of the blade is a concave arc, the rear edge is a convex arc, and the blade is arcuate as a whole when viewed from a horizontal plane, the front edge of the blade is located in a higher level than the rear edge, the blade includes a connecting end and an outer end, when each blade is located in a retracted position, the height of the front edge of the blade is at the same level from the connecting end to the outer end, and the height of the rear edge of the blade is at the same level from the connecting end to the outer end, and a gap is created between the outer end of the blade and the connecting end of another adjacent blade, and there is no overlap between two adjacent blades, and a lamp is arranged at the bottom of the motor.

* * * * *